United States Patent [19]

Higashimoto

[11] Patent Number: 4,512,523

[45] Date of Patent: Apr. 23, 1985

[54] APPARATUS FOR MINCING FROZEN MEAT INTO GROUND MEAT

[75] Inventor: Tsuyoshi Higashimoto, Ikoma, Japan

[73] Assignee: Higashimoto Kikai Co., Ltd., Japan

[21] Appl. No.: 514,464

[22] Filed: Jul. 18, 1983

[30] Foreign Application Priority Data

Jul. 26, 1982 [JP] Japan ..... 57-114350[U]

[51] Int. Cl.[3] ..... B02C 18/30

[52] U.S. Cl. ..... 241/82.4; 241/82.5; 241/82.7; 241/152 R; 241/260.1

[58] Field of Search ..... 241/82.1–82.7, 241/260.1, 152 R, 161, 162, 163, 101 D

[56] References Cited

U.S. PATENT DOCUMENTS

| | | | |
|---|---|---|---|
| 3,035,622 | 5/1962 | Biro | 241/82.4 |
| 4,181,265 | 1/1980 | Young et al. | 241/260.1 X |

FOREIGN PATENT DOCUMENTS

| | | | |
|---|---|---|---|
| 2812536 | 9/1979 | Fed. Rep. of Germany | 241/82.1 |
| 2947510 | 5/1981 | Fed. Rep. of Germany | 241/82.5 |
| 2090779 | 1/1972 | France | 241/82.1 |
| 192139 | 10/1937 | Switzerland | 241/82.2 |
| 2064306 | 6/1981 | United Kingdom | 241/82.7 |

OTHER PUBLICATIONS

Block Chopping Extructor, Rietz Division, 7-17-83.

Weiler Heavy Duty Food Grinders, Weiler & Company, 1-27-83.

*Primary Examiner*—Mark Rosenbaum

*Attorney, Agent, or Firm*—Kirschstein, Kirschstein, Ottinger & Israel

[57] ABSTRACT

The apparatus for mincing frozen meat into ground meat according to the invention comprises a crusher roll rotatably installed in a hopper and a main roll rotatably installed in a pipe. The lower region of the hopper communicates with the pipe. Frozen meat is charged into the hopper and crushed by the cutting edges of the crusher roll. Crushed meat is then pushed into the pipe by the feed vanes of the crusher roll and fed to a mincing position by the feed vane of the main roll.

6 Claims, 6 Drawing Figures

APPARATUS FOR MINCING FROZEN MEAT INTO GROUND MEAT

BACKGROUND OF THE INVENTION

This invention relates to a meat grinding apparatus for grinding frozen meat into ground meat.

When meat is to be ground, a so-called meat grinder for automatically mincing it is commonly used. Although these types of grinders are convenient in cases where unfrozen meat is processed into ground meat, a problem arises in cases where a frozen mass of meat, i.e., frozen meat is processed into ground meat. For example, if frozen meat, as such, is put into the hopper of the grinder, it is fed to the mincing position, where it is minced. As a result, the frozen meat is minced forcibly or in abnormal condition, damaging the meat structure and imposing excessively high mechanical loads on the grinder in feeding and mincing frozen meat, threatening to damage the apparatus. To avoid this danger, it is necessary to crush the frozen meat by another apparatus before it is put into the hopper of the grinder. In this case, however, the frozen meat must be first charged into said another apparatus, where it is crushed, whereupon the crushed meat must be taken out of the crushing apparatus, and then it must be charged into the hopper of the grinder, thus giving rise to a disadvantage that the operation is troublesome and inefficient.

An object of this invention is to provide a frozen meat grinder, which eliminates the aforesaid conventional disadvantage and which is capable of crushing frozen meat charged into the hopper, and then smoothly and continuously feeding it to the mincing position, and mincing it.

Another object of this invention is to provide a meat grinding apparatus having a crusher roll for crushing frozen meat charged into the hopper and pushing the crushed meat into a pipe, and a main roll for feeding the crushed meat, which is pushed into the pipe, to the mincing position.

A further object of this invention is to provide a meat grinding apparatus designed so that the rotary shaft of the crusher roll for crushing frozen meat is rotated at a relatively low speed to avoid damage to the crusher roll, while the rotary shaft of the main roll for feeding meat to the mincing position is rotated at a relatively high speed to mince the crushed meat sharply at the mincing position.

Another object of this invention is to provide a meat grinding apparatus, wherein the outer diameter of the feed vanes of the crusher roll and the inner diameter of the bottom surface of the hopper are relatively large, while the outer diameter of the feed vane of the main roll and the inner diameter of the pipe are relatively small, and the meat feed rate of the crusher roll is equal to that of the main roll, the crushed meat being accurately and continuously fed to the mincing position by the feed vanes of the crusher roll and main roll.

SUMMARY OF THE INVENTION

According to this invention, a crusher roll is rotatably installed in the elongated semi-cylindrical lower region of a hopper into which frozen meat is charged. The crusher roll has a rotary shaft which is provided with a plurality of axially spaced feed vanes, each of which is formed with a cutting edge for crushing frozen meat, said crusher roll being disposed so that the rotary shaft extends lengthwise of the semi-cylindrical bottom region of the hopper with the feed vanes and cutting edges transversely arranged with respect to the rotary shaft. Thus, when the crusher roll is rotated and frozen meat is charged from above into the hopper, the cutting edges of the feed vanes strike the charged frozen meat, so that the frozen meat is crushed by the cutting edges. Further, a plurality of projections are provided on the inner surface of the hopper, each projection disposed between adjacent feed vanes of the crusher roll. The lower region of the hopper communicates with a pipe. The plurality of projections prevent idle rotation of frozen meat. The crushed meat is pushed into the pipe by the feed vanes of the crusher roll. A main roll having a suitable feed vane, e.g., a spiral feed vane formed on its rotary shaft is rotatably installed in the pipe, so that the meat pushed into the pipe is fed to a meat processing position by the feed vane of the main roll and minced into ground meat. The pipe and the main roll are arranged so that the rotary shaft of the main roll crosses the rotary shaft of the crusher roll, whereby the meat pushed into the pipe is smoothly and continuously fed to the mincing position.

BRIEF DESCRIPTION OF THE DRAWINGS

The invention will be further described with reference to the accompanying drawings.

DETAILED DESCRIPTION OF THE PREFERRED EMBODIMENT

Figure 1:
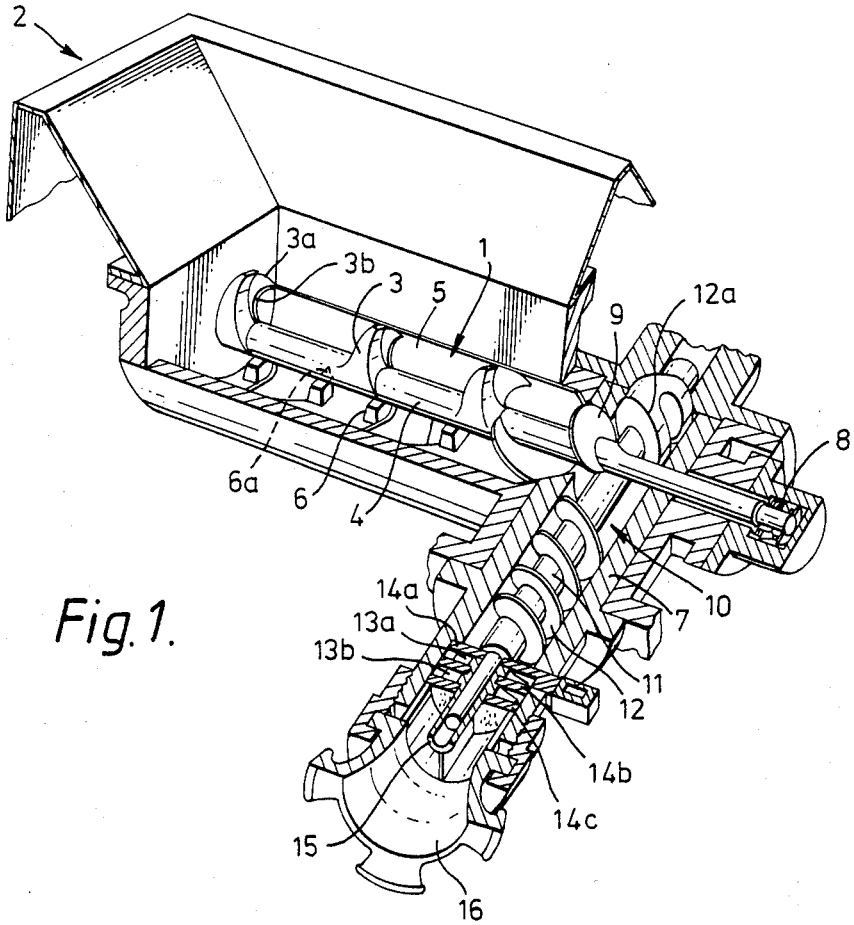
FIG. 1 is a cutaway perspective view showing an embodiment of this invention.
Figure 2:
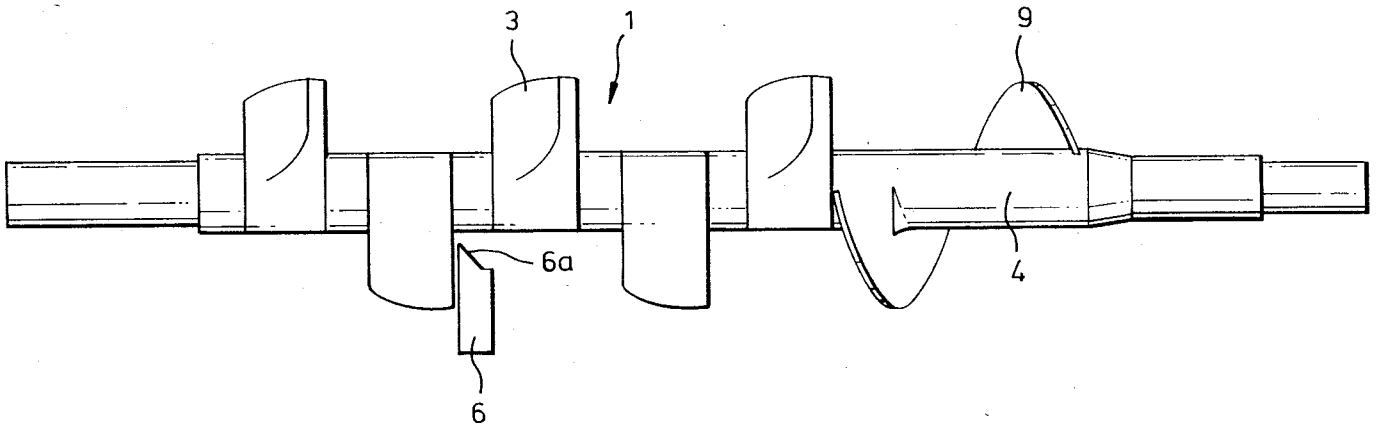
FIG. 2 is a side view of a crusher roll in FIG. 1.
Figure 3:
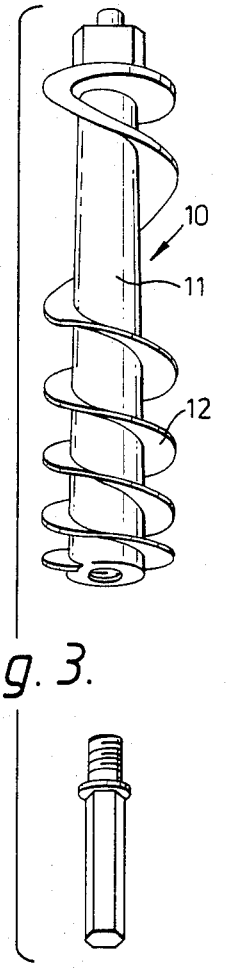
FIG. 3 is an exploded perspective view of a main roll in FIG. 1.

In the drawings, a crusher roll 1 is rotatably installed in the lower region of a hopper 2 into which frozen meat is charged. The crusher roll 1 have five pawl-shaped feed vanes 3 which are formed on a rotary shaft 4, axially equispaced and shifted through 180° from each other (see FIG. 2). The cutting edges are formed on the front end 3*a* and lateral edge 3*b* of each feed vane 3. The bottom surface 5 of the hopper 2 is semicylindrical, and the rotary shaft 4 of the crusher roll 1 extends coaxially of said semi-cylindrical bottom surface, with the feed vanes 3 and cutting edges arranged transversely along the bottom surface 5 of the hopper 2. A plurality of projections 6 for preventing idle rotation of frozen meat are installed on the inner surface 5 of the hopper 2, each projection being disposed between adjacent feed vanes 3. Each projection 6 has an inclined surface 6*a* (see also FIG. 2) which is axially inclined toward the direction of rotation of the feed vanes 3.

Figure 6:
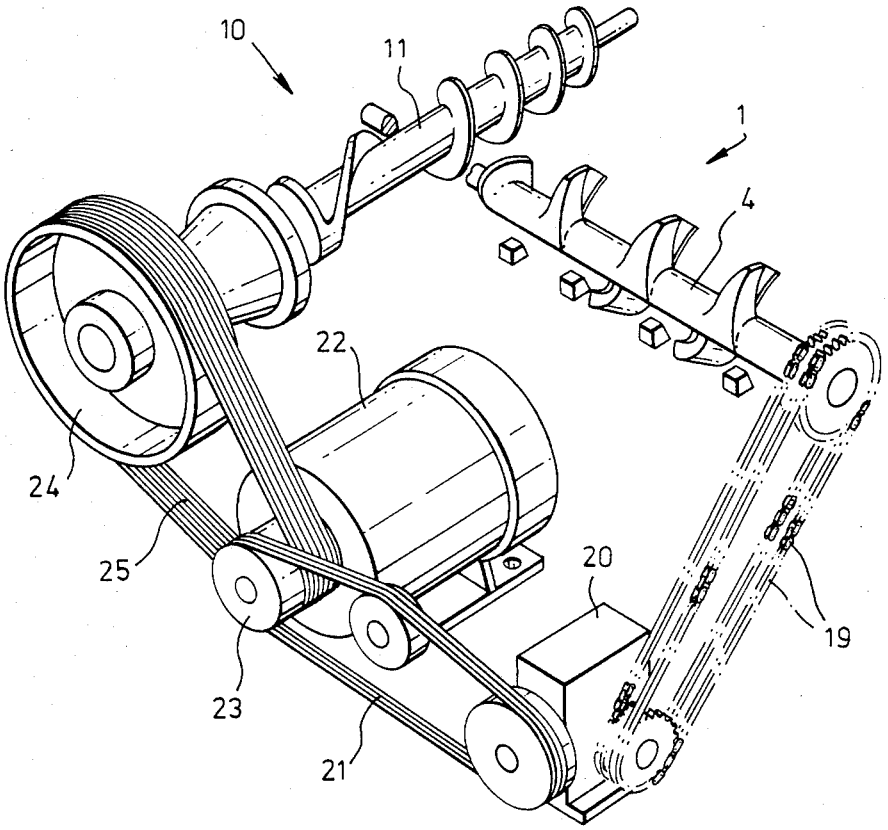
FIG. 6 is a perspective view showing a driving system for rotating the main roll and crusher roll.

The lower region of the hopper 2 communicates with a pipe 7 located near at one end of the rotary shaft 4. One end of the rotary shaft 4 extends transversely through the pipe 7 and is rotatably supported in a bearing 8. In this embodiment, besides the pawl-shaped feed vanes 3, the rotary shaft 4 is provided with a spiral feed vane 9 slightly projecting into the pipe 7. The other end of the rotary shaft 4 is connected to a driving mechanism such as a motor 22 (FIG. 6).

A main roll 10 is rotatably installed in the pipe 7. The main roll 10 has a spiral feed vane 12 formed on its rotary shaft 11, and the pipe 7 and main roll 10 are arranged so that the rotary shaft 11 of the main roll 10 crosses the rotary shaft 4 of the crusher roll 1. The inner peripheral surface of the pipe 7 is formed with a spiral feed guide groove (not shown). Further, in this embodiment, the feed vane 12 of the main roll 10 is axially divided into a main feed zone 12 and an auxiliary feed zone 12*a* and a cutting edge is formed on the peripheral edge of the feed vane 12*a*. The rotary shaft 4 of the crusher roll 1 is disposed between the two divisions of the feed vanes 12.

In this embodiment, meat is minced by two cutters 13*a* and 13*b* and three plates 14*a*, 14*b* and 14*c* into ground meat. The plates 14*a*, 14*b* and 14*c* are spaced apart from each other axially of the rotary shaft 11 of the main roll 10 and fixed to the inner peripheral surface of the pipe 7. The cutters 13*a* and 13*b* are disposed between the plates 14*a*, 14*b* and 14*c* and fixed to one end of the rotary shaft 11. One end of the rotary shaft 11 is rotatably supported in a bearing ring 15 and the other end is connected to the driving mechanism. The bearing ring 15 is disposed between the plate 14*c* and a funnel 16 and fixed in position.

Figure 4:
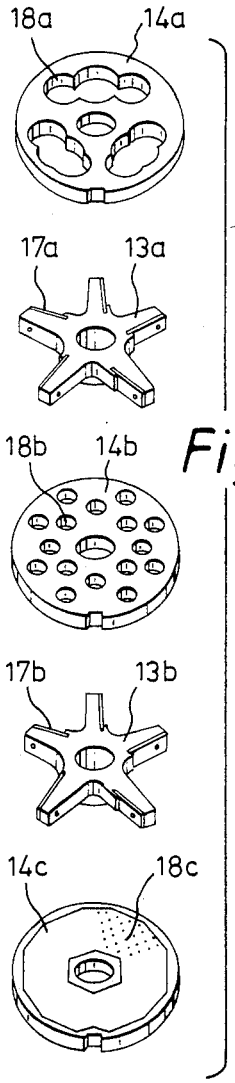
FIG. 4 is an exploded perspective view of cutters and plates in FIG. 1.
Figure 5:
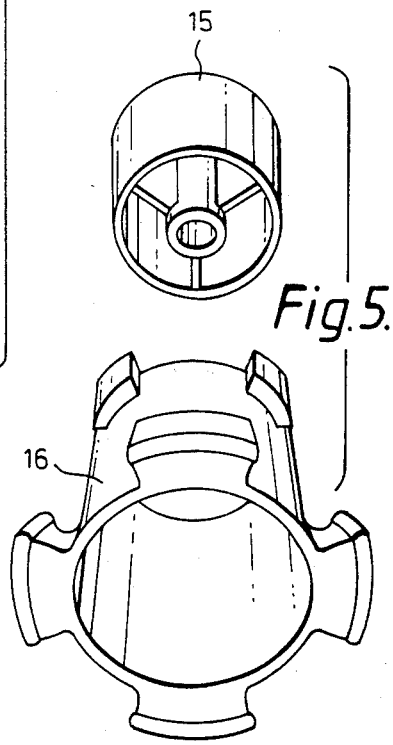
FIG. 5 is an exploded perspective view of a bearing ring and a funnel in FIG. 1.

As shown in FIG. 4, the cutters 13*a* and 13*b* are of the same contruction, having five cutting blades 17*a*, 17*b* radially projecting at equal angular intervals. The plates 14*a*, 14*b* and 14*c* are disk-shaped, and the plate 14*a* has three large throughgoing holes 18*a* for passage of meat and the plate 14*b* has a number of small throughgoing holes 18*b*. The plate 14*c* has innumerable smaller throughgoing holes 18*c*.

As shown in FIG. 6, the rotary shaft 4 of the crusher roll 1 is connected to the driving shaft 23 of a prime mover, i.e., an electric motor 22 through chains 19, a speed reducer 20 and belts 21. The rotary shaft 11 of the main roll 10 is connected to the driving shaft 23 of the prime mover 22 through a pulley 24 and belts 25. The speed reducer 20 reduces the rotation of the driving shaft 23 and transmits the reduced rotation to the rotary shaft 4 of the crusher roll 1. The pulley 24 reduces the rotation of the driving shaft 23 and transmits the reduced rotation to the rotary shaft 11 of the main roll 10. As will be later described, the rotary shaft 4 of the crusher roll 1 rotates at a relatively low speed, while the rotary shaft 11 of the main roll 10 rotates at a relatively high speed.

In the meat grinding apparatus constructed in the manner described above, when the driving mechanisms, such as a motor, is driven, the pawl-shaped feed vanes 3 and the spiral feed vane 9 of the crusher roll 1 are rotated simultaneously with the rotary shaft 4 along the bottom surface 5 of the hopper 2. Thus, if frozen meat is charged from above into the hopper 2, the cutting edges, i.e., front ends 3*a* and lateral edges 3*b* of the pawl-shaped feed vanes 3 intermittently strike the charged frozen meat. Therefore, the frozen meat is crushed by the cutting edges of the feed vanes 3.

The crushed meat falls down into the lower region of the hopper, i.e., the region where the crusher roll 1 is housed. The meat that falls comes in contact with the projections 6 on the bottom surface 5 of the hopper 2, said projections 6 preventing the frozen meat from idly rotating integrally with the feed vanes 3 of the crusher roll 1. Therefore, the crushed meat is fed axially of the rotary shaft4 by the pawl-shaped feed vanes 3 and spiral vane 9 and pushed into the pipe 7. The inclined surfaces 6*a* of the projections 6 act to guide the frozen meat in the direction of the axis.

Further, when the driving mechanism is operating, the spiral feed vane 12 of the main roll 10 is rotated simultaneously with the rotary shaft 11 along the line peripheral surface of the pipe 7. Therefore, the peripheral edge 12*a* of the feed vane 12 strikes the meat pushed into the pipe 7 to propel the same. The propelled meat is fed axially of the rotary shaft 11 by the feed vane 12 and the guide groove of the pipe 7 until it reaches a mincing position, i.e., the position where the cutters 13*a* and 13*b* and plates 14*a*, 14*b*, and 14*c* are located. Since the pipe 7 and main roll 10 are so positioned that the rotary shaft 11 of the main roll 10 crosses the rotary shaft 4 of the crusher roll 1, the meat pushed into the pipe 7 is smoothly and continuously fed to the mincing position by the feed vane 12 of the main roll 10.

The meat fed to the mincing position is first pushed into the throughgoing holes 18*a* of the plate 14*a* and passed through said holes. One cutter 13*a* at the mincing position is rotated simultaneously with the rotary shaft 11 of the main roll 10 between the plates 14*a* and 14*b*. Therefore, the meat passed through the throughgoing holes 18*a* is nipped between the cutting blades 17*a* of the cutter 13*a* and the plate 14*a* and cut by the cutter 17*a*. The cut meat is pushed into the throughgoing holes 18*b* of the plate 14*b*, nipped between the cutting blades 17*b* of the cutter 13, and further cut by the cutting edges 17*a*, whereupon it is passed through the throughgoing holes 18*b* of the plate 14*b*. The other cutter 13*b* is rotated simultaneously with the rotary shaft 11 of the main roll 10 between the plates 14*b* and 14*c*. Therefore, the meat passed through the throughgoing holes 18*b* is nipped between the cutting blades 17*b* of the cutter 13*b* and the plate 14*b* and further cut by the cutting blades 17*b*. It is pushed into the throughgoing holes 18*c* of the plate 14*c*, nipped between the cutting blades 17*b* of the cutter 13*b* and the plate 14*c* and further minced by the cutting blades 17*b*, whereupon it is passed through the throughgoing holes 18*c*. The meat processed into ground meat is pushed into the funnel 16 and taken out.

The frozen meat charged into the hopper 2 has been frozen at a low temperature between −25° C. and −30° C. and is very hard. Thus, if the rotary shaft 4 of the crusher roll 1 is rotated at a high speed, there is the danger of the crusher roll 1 being damaged as it is subjected to a heavy shock and load when the cutting blades of the crusher roll 1 strike the frozen meat. Therefore, the rotary shaft 4 of the crusher roll 1 must be rotated at a relatively low speed. In contrast, as for the main roll 10, it is necessary to rotate the rotary shaft 11 and cutters 13*a* and 13*b* at a relatively high speed so that the meat can be sharply cut by the cutters 13*a* and 13*b* and plates 14*a*, 14*b*, and 14*c*. In this apparatus, since the rotary shafts 4 and 11 of the crusher roll 1 and main roll 10 are distinctly separate but kinematically interconnected mechanisms, driven from a common motive source through different kinematic trains, it is possible to rotate the rotary shaft 4 of the crusher roll 1 at a relatively low speed while rotating the rotary shaft 11 of the main roll 10 at a relatively high speed. Therefore, it is possible to avoid damage to the crusher roll 1 and to sharply mince the meat by the cutters 13*a* and 13*b* and plates 14*a*, 14*b*, and 14*c*.

Since the rotary shafts 4 and 11 of the crusher roll 1 and main roll 10 are connected to the common prime mover 22 through different transmission mechanisms, the rotative speeds of the rotary shafts 4 and 11 can be made different from each other and the ratio of their rotative speeds can be kept constant.

It has already been described that the meat crushed by the cutting edges of the crusher roll 1 is fed to the mincing position by the feed vanes 3 and 9 and the crusher roll 1 and by the feed vane 12 of the main roll 10. In order to feed meat to the mincing position accurately and continuously, it is necessary that the meat feed rate of the feed vanes 3 and 9 of the crusher roll 1 be equal to that of the feed vane 12 of the main roll 10. The meat feed rate of the feed vanes 3 and 9 is determined by the outer diameters of the feed vanes 3 and 9, the inner diameter of the bottom surface 5 of the hopper 2, and the RPM of the rotary shaft 4. The meat feed rate of the feed vane 12 is determined by the outer diameter of the feed vane 12, the inner diameter of the pipe 7 and the RPM of the rotary shaft 11. As shown, when the rotary shaft 4 of the crusher roll 1 is rotated at a relatively low speed, the outer diameters of the feed vanes 3 and 9 of the crusher roll 1 and the inner diameter of the bottom surface 5 of the hopper 2 are selected relatively large, while the outer diameter of the feed vane 12 of the main roll 10 and the inner diameter of the pipe 7 are selected relatively small. Further, in this apparatus, since the lower region of the hopper 2 communicates with the pipe 7 and the rotary shaft 11 of the main roll 10 crosses the rotary shaft 4 of the crusher roll 1, meat crushed by the cutting edges of the crusher roll 1 can be pushed out of the lower region of the hopper 2 into the pipe 7. Therefore, the meat can be smoothly fed to the mincing position by the feed vanes 3 and 9 of the crusher roll 10 and the feed vane 12 of the main roll 10. Since the crushed meat is fed to the mincing position, the frozen meat can be minced without excessive force which would damage the meat structure.

As has been described so far, this invention makes it possible to put frozen meat, as such, in the hopper and mince it into ground meat. Thus, the operation can be made simple and efficient to achieve the intended object.

What is claimed is:

1. An apparatus for converting frozen meat into minced meat, said apparatus comprising:

(A) a hopper into which frozen meat is charged, said hopper having
  (i) an open top,
  (ii) a lower region,
  (iii) the lower region being of elongated semi-cylindrical configuration, and
  (iv) an outlet at one end of said lower region, (B) a crusher roll rotatably mounted in said hopper, and constituting
  (i) a rotary shaft and
  (ii) a plurality of pawl-shaped feed vanes axially spaced along said shaft and extending radially therefrom,
  (iii) each feed vane having a cutting edge for crushing frozen meat fed into the hopper,
  (iv) said crusher roll being disposed with its rotary shaft extending coaxially of the longitudinal axis of the elongated semi-cylindrical lower region of the hopper,
  (v) the feed vanes and cutting edges of the crusher roll being disposed transversely of the longitudinal axis of said lower region of the hopper, (C) a plurality of stationary projections on the inner surface of said hopper, said projections being disposed between adjacent feed vanes for preventing idle rotation of frozen meat as it is crushed and for guiding the crushed frozen meat toward the outlet of the hopper, (D) a pipe having an inlet communicating with the outlet of the hopper through which the meat crushed in the hopper is fed to the inlet to the pipe, (E) a main roll rotatably mounted in said pipe, and having a rotary shaft and a main spiral feed vane formed on said rotary shaft,
  (i) said pipe and main roll and rotary shaft being so disposed that the rotary shaft of the main roll crosses the rotary shaft of the crusher roll adjacent the outlet of the hopper, (F) said rotary shaft of said crusher roll also having a spiral vane slightly projecting into said pipe to push crushed meat from the lower region of the hopper into the pipe, (G) said rotary shaft of said main roll also having an auxiliary feed vane to advance crushed frozen meat fed into the spiral vane from the hopper toward the spiral vane on the rotary shaft of the main roll, (H) said rotary shaft of the main roll further having cutter blades mounted thereon upstream of the spiral vane which turn with the main shaft, (I) said pipe having plates stationarily mounted therein with said cutter blades interposed therebetween and with apertures therethrough for cooperation with said cutter blades to mince meat advanced therethrough by the main feed vane after having been crushed in the hopper and pushed from the hopper outlet into the pipe, and (J) power means to turn said shafts simultaneously, (K) whereby frozen meat charged into said hopper is crushed by the cutting edges of the crusher roll, pushed through the outlet of the hopper into said pipe by the spiral vane on the rotary shaft of the crusher roll, advanced by the auxiliary feed vane and fed to the cutter blades and plates at a mincing position by the main feed vane of the main roll.

2. An apparatus as set forth in claim 1, wherein the power means is a common prime mover, and wherein different transmission mechanisms connect the prime mover to the rotary shafts of the crusher roll and the main roll to rotate the rotary shaft with the crusher roll at a speed which is relatively low compared to the speed at which the rotary shaft of the main roll is rotated.

3. An apparatus as set forth in claim 1, wherein the outer diameter of the crusher roll and the inner diameter of the bottom surface of the lower region of the hopper are large relative to the outer diameter of the feed vane of the main roll and the inner diameter of the pipe, such that the feed rates of meat at the outlet of the hopper and at the mincing position are substantially equal to each other.

4. An apparatus as set forth in claim 1, wherein the projections have inclined surfaces against which the frozen meat crushed by the crusher roll is pressed, which inclined surfaces are so oriented as to guide the crushed meat in the direction toward the outlet of the hopper.

5. An apparatus as set forth in claim 1, wherein the pipe downstream of the most downstream plate flares smoothly outwardly.

6. The apparatus as set forth in claim 1, wherein the apertures in the plates which are progressively downstream of one another are progressively smaller.

* * * * *